US007971719B2

(12) United States Patent
Postow

(10) Patent No.: US 7,971,719 B2
(45) Date of Patent: Jul. 5, 2011

(54) COMBINATION DAILY REMINDER AND HOLDER FOR MEDICINALS

(76) Inventor: Maxwell Postow, Rockville, MD (US)

( * ) Notice: Subject to any disclaimer, the term of this patent is extended or adjusted under 35 U.S.C. 154(b) by 0 days.

(21) Appl. No.: 12/801,878

(22) Filed: Jun. 30, 2010

(65) Prior Publication Data

US 2011/0011764 A1 Jan. 20, 2011

Related U.S. Application Data

(60) Provisional application No. 61/213,797, filed on Jul. 16, 2009.

(51) Int. Cl.
*B65D 83/04* (2006.01)

(52) U.S. Cl. ..... 206/534; 206/805

(58) Field of Classification Search ..... 206/805, 206/534, 495, 479, 478
See application file for complete search history.

(56) References Cited

U.S. PATENT DOCUMENTS

| | | | | |
|---|---|---|---|---|
| 1,714,688 | A * | 5/1929 | Mikkelsen | 206/449 |
| 2,328,522 | A * | 8/1943 | Yocum | 221/33 |
| 5,385,237 | A * | 1/1995 | Mathews | 206/574 |
| 2007/0131576 | A1 * | 6/2007 | Ehling et al. | 206/528 |
| 2008/0047867 | A1 * | 2/2008 | Holmberg | 206/534 |

* cited by examiner

*Primary Examiner* — Gregory Pickett
*Assistant Examiner* — Raven Collins
(74) *Attorney, Agent, or Firm* — Marc Caroff

(57) ABSTRACT

A product or device for holding medicinals, and serving as a convenient daily reminder to the user to take the medicinals at prescribed periodic intervals. The device comprises a board having ridges or slots on each side, with the ridges or slots arranged in a saw-tooth configuration. Indicia are inscribed on the board to indicate to the user when each medicinal is to be taken. A length of flexible or elastic material is affixed to the board and interwoven on each side of the board along the ridges or slots to hold the medicinals in place until removed by the user.

6 Claims, 2 Drawing Sheets

COMBINATION DAILY REMINDER AND HOLDER FOR MEDICINALS

CROSS-REFERENCE TO RELATED APPLICATION

This application claims benefit of priority of provisional patent application No. 61/213,797, filed Jul. 16, 2009.

BACKGROUND AND SUMMARY OF THE INVENTION

This invention is a product or device for holding prescription or non-prescription pills, capsules, or other medicinals and, in addition, serving as a convenient daily reminder to the user to take or dispense the medicinal at prescribed periodic intervals.

Previously, pill boxes or compartmental containers have been used for these purposes. The present invention is an effective alternative to these products, and is particularly suited for holding bottle-shaped plastic containers or miniature vials containing measured doses of eye-drops which must be applied at periodic intervals.

DETAILED DESCRIPTION OF THE PRESENT INVENTION

Figure 1:
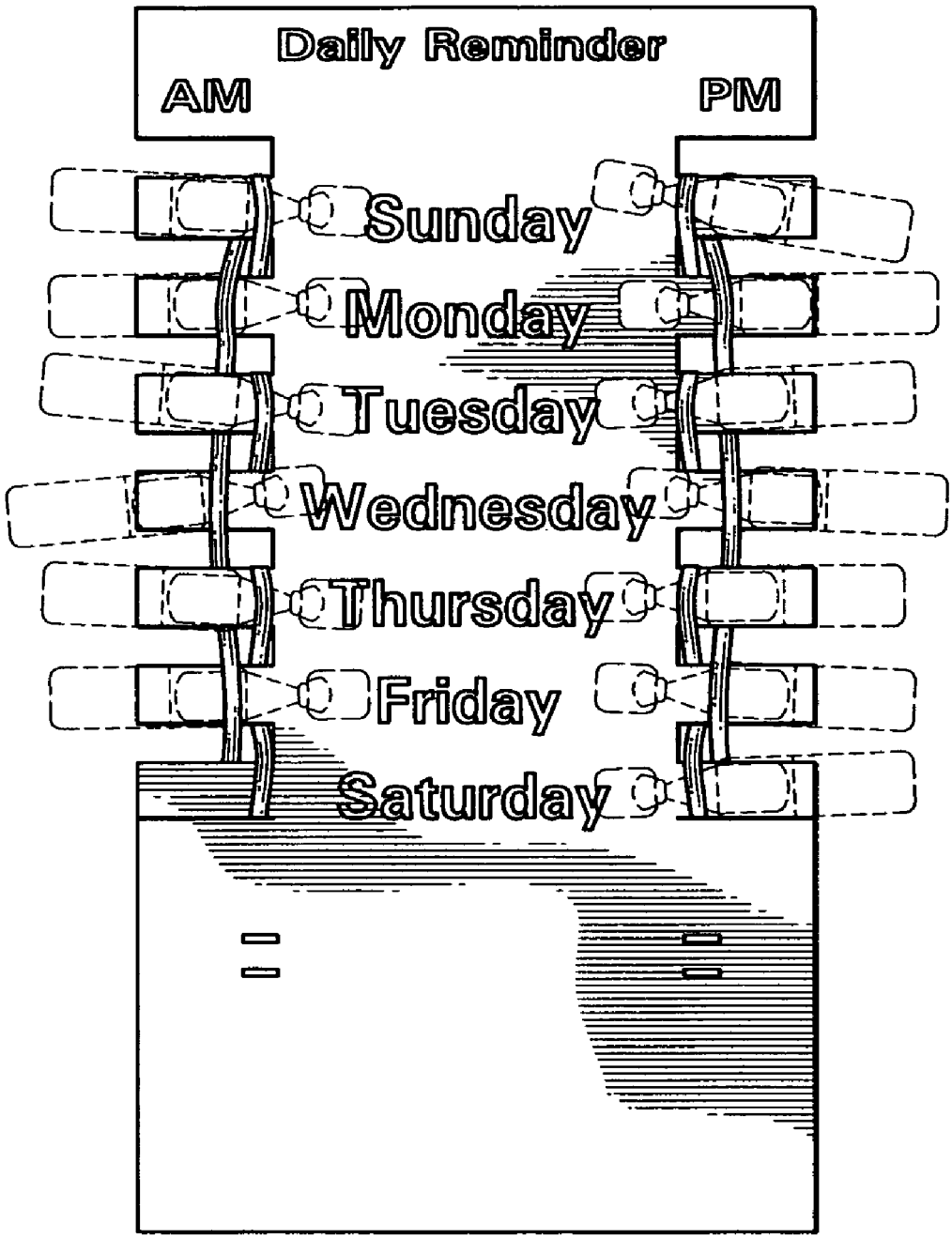
FIG. 1 is a front view of an embodiment of the present invention showing a series of miniature plastic eye-drop vials held and arranged so that they can be easily removed and used in a prescribed manner; with two vials being used on a daily basis—one in the morning, and the other in the afternoon or evening.

The present invention is a device composed of two basic structural elements. The first element is a flat board shaped or cut to include ridges or slots on each side in a saw-tooth configuration as shown in FIG. 1. The board may be composed of cardboard, plastic, wood, metal, or any other suitable material. Indicia are inscribed on the face of the board to indicate the day of the week, and the time of day, on which the medicinals are to be dispensed. For example, according to the embodiment illustrated in FIG. 1, the inscriptions on the board serve as a reminder that plastic vials are to be removed and utilized at periodic intervals on each day of the week.

The second structural element of the present invention consists of a length of flexible or elastic material that holds the medicinals in place; and allows for their easy removal when it is time to use them. This element can be composed of any flexible or elastic material such as an elastic band, string, nylon cord, or even metal wire.

Figure 2:
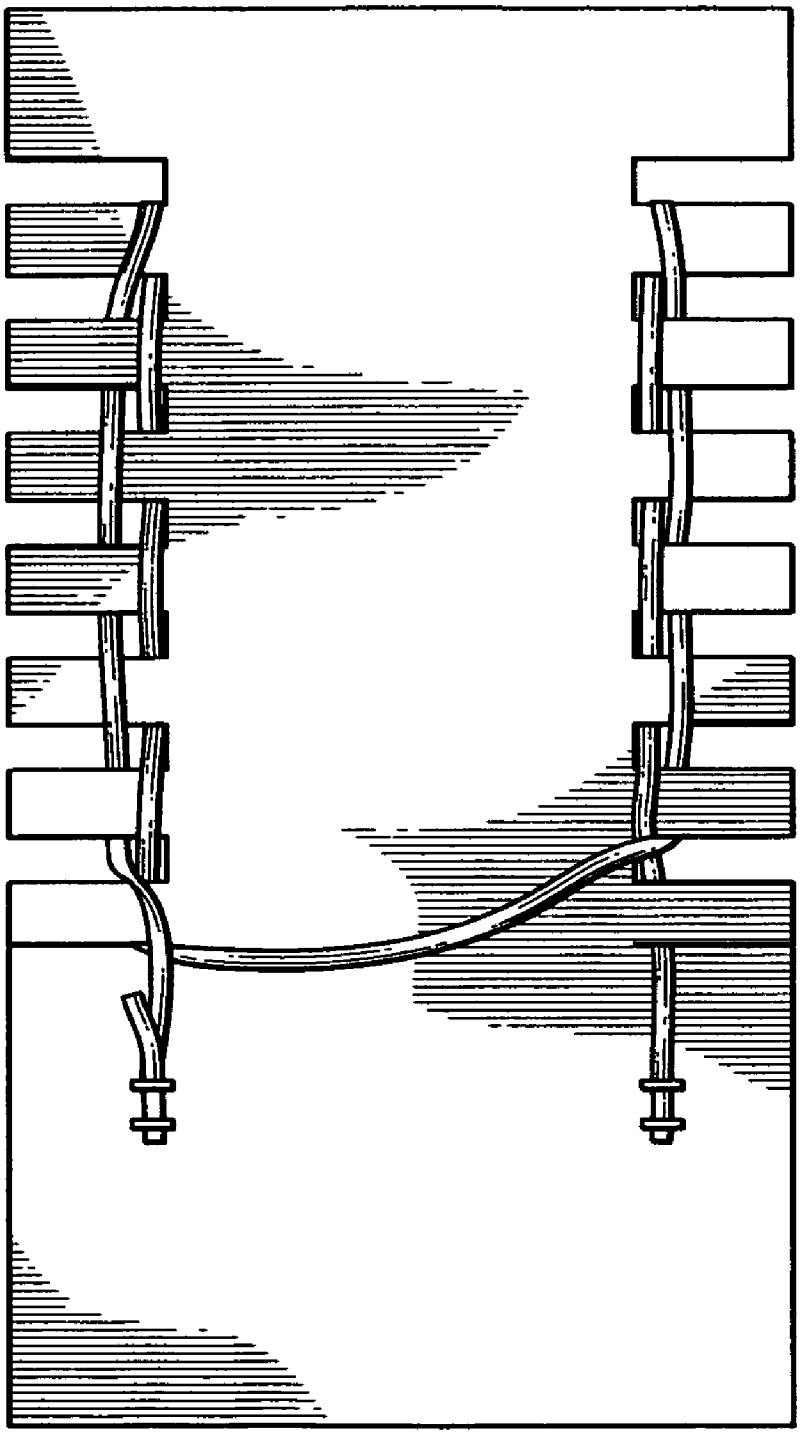
FIG. 2 is a view of the back of the same embodiment of the present invention.

As shown in both FIG. 1 and FIG. 2, the length of material, preferably an elastic band, is affixed to the board at one end (as with a staple) and twice interwoven over and under the saw-tooth configuration of slots or ridges on each side of the board, with the other end of the elastic band then also affixed to the board. The overall configuration of the board and elastic band allows for convenient and easy placement and removal of medicinals onto and from the present device as desired by the user of the medicinal.

Alternatively, the length of material can either consist of one continuous strand (as shown in FIG. 1 and FIG. 2), or it can consist of two separate strands, with the two strands affixed on opposite sides of the board and with each strand interwoven over and under the slots or ridges on its side of the board.

While the present invention has been described with reference to particular embodiments, those of ordinary skill in this field of endeavor will understand that there may be other embodiments within the scope of this invention.

The following claims should be liberally construed in a manner consistent with the considerable scope of the present invention, and should not be restricted to their literal terms.

What is claimed is:

1. A device for holding medicinals and serving as a daily reminder for their use comprising:

(a) a board including ridges or slots on each side of the board arranged in a saw-tooth configuration;

(b) indicia inscribed on a face of the board indicating the day of the week and the time of day on which each medicinal is to be used; and (c) a length of flexible or elastic material affixed to the board, wherein a continuous length of the material is sequentially interwoven over and under adjacent slots or ridges along the saw-tooth configuration of slots or ridges on each side of the board.

2. The device as defined in claim 1, wherein the board is composed of either cardboard, plastic, wood, or metal.

3. The device as defined in claim 1, wherein the length of material is either an elastic band, a string, a nylon cord, or a metal wire.

4. The device as defined in claim 1, wherein the length of material consists of one continuous strand.

5. The device as defined in claim 1, wherein the length of material consists of two separate strands, with the strands affixed on opposite sides of the board.

6. The device as defined in claim 1, wherein a plurality of medicinals can be retained by the length of material on each side of the board.

* * * * *